US011891234B2

(12) United States Patent
Pearson et al.

(10) Patent No.: US 11,891,234 B2
(45) Date of Patent: Feb. 6, 2024

(54) WIRE REEL STORAGE BOX

(71) Applicant: Klein Tools, Inc., Lincolnshire, IL (US)

(72) Inventors: Daniel Pearson, Fort Worth, TX (US); Daniel Flores, Dallas, TX (US); Robert Rivera, Euless, TX (US)

(73) Assignee: Klein Tools, Inc., Lincolnshire, IL (US)

( * ) Notice: Subject to any disclaimer, the term of this patent is extended or adjusted under 35 U.S.C. 154(b) by 32 days.

(21) Appl. No.: 17/461,007

(22) Filed: Aug. 30, 2021

(65) Prior Publication Data

US 2023/0066675 A1 Mar. 2, 2023

(51) Int. Cl.

| | |
|---|---|
| ***B65D 85/67*** | (2006.01) |
| ***B65D 25/32*** | (2006.01) |
| ***B65D 25/10*** | (2006.01) |
| ***B65D 25/08*** | (2006.01) |
| ***B65D 43/06*** | (2006.01) |

(52) U.S. Cl.

CPC ..... *B65D 85/67* (2013.01); *B65D 25/08* (2013.01); *B65D 25/106* (2013.01); *B65D 25/32* (2013.01); *B65D 43/06* (2013.01)

(58) Field of Classification Search

CPC ..... B65D 85/67; B65D 25/08; B65D 25/106; B65D 43/16

USPC ..... 206/408

See application file for complete search history.

(56) References Cited

U.S. PATENT DOCUMENTS 616,505 A * 12/1898 Sutro ..... B65D 85/672 206/408
915,286 A * 3/1909 Haas ..... B65D 5/728 312/351
922,695 A * 5/1909 Haas ..... B65D 5/728 206/408
951,562 A * 3/1910 Hamelstrom ..... B65H 35/0046 118/235
2,136,587 A * 11/1938 Gaskill ..... A01K 39/00 119/61.31
2,268,547 A * 1/1942 Haines ..... B65H 49/322 242/137.1
4,685,633 A * 8/1987 Pellini ..... B65H 49/328 242/598.5
5,040,483 A * 8/1991 Lieberman ..... B44C 7/02 118/DIG. 17
5,193,680 A * 3/1993 Schumann ..... B65H 49/325 206/394
5,472,088 A * 12/1995 Roberts ..... B65D 85/672 206/394
5,704,479 A * 1/1998 Barnett ..... B65H 49/322 206/416

(Continued)

*Primary Examiner* — Ernesto A Grano

(57) ABSTRACT

A storage box includes a compartment having a base and opposed sidewalls extending from the base. Each sidewall of the opposed sidewalls includes two first retaining surfaces extend away from the base and along the sidewall where the first retaining surfaces are a first distance away from each other. Each sidewall includes two parallel second retaining surfaces extending away from the first retaining surfaces and along the sidewall. The second retaining surfaces are a second distance away from each other and the second distance is greater than the first distance. The storage box includes a rod, and support surfaces associated with each sidewall of the first pair of opposed sidewalls are configured to support the rod.

19 Claims, 8 Drawing Sheets

(56) References Cited

U.S. PATENT DOCUMENTS

| | | | | |
|---|---|---|---|---|
| 6,276,623 | B1 * | 8/2001 | Williams | B65H 49/322 242/129 |
| 6,315,122 | B1 * | 11/2001 | McCord | B65D 19/44 206/413 |
| 7,320,445 | B2 * | 1/2008 | Eastwood | B65H 49/322 242/598.6 |
| 8,251,212 | B2 * | 8/2012 | Dunlap | B65D 85/04 206/403 |
| 8,336,711 | B2 * | 12/2012 | Katsurayama | B65D 19/06 206/407 |
| 8,371,519 | B2 * | 2/2013 | McManus | B65H 49/322 242/129.6 |
| 9,908,737 | B2 * | 3/2018 | Chastain | B65H 75/30 |
| 10,239,725 | B2 * | 3/2019 | Chastain | B65H 75/185 |
| D925,225 | S * | 7/2021 | Hazelton | D3/304 |
| 11,319,142 | B2 * | 5/2022 | Crossett | B65H 75/285 |
| 11,407,609 | B1 * | 8/2022 | Haag | B65H 75/141 |
| 11,459,205 | B2 * | 10/2022 | Roussel | B65H 49/321 |
| 2001/0006202 | A1 * | 7/2001 | Inana | B65H 75/08 242/573 |
| 2002/0125161 | A1 * | 9/2002 | Cote | B65H 49/322 206/397 |
| 2005/0035240 | A1 * | 2/2005 | Weck | B65H 49/322 242/588.4 |
| 2010/0163667 | A1 * | 7/2010 | Dorais | B65H 49/325 242/588.6 |
| 2013/0087652 | A1 * | 4/2013 | Chastain | B65H 49/205 242/588.3 |

* cited by examiner

WIRE REEL STORAGE BOX

BACKGROUND OF THE DISCLOSURE

The present disclosure relates to storage boxes. Storage boxes may include dividers to separate the storage boxes into smaller compartments and may be used to store reels of materials such as wire, cables, and ropes.

BRIEF SUMMARY OF THE DISCLOSURE

In accordance with one feature of this disclosure, a storage box is provided and includes a compartment having a base, a first pair of opposed sidewalls extending from the base, and a second pair of opposed sidewalls extending from the base. Each sidewall of the first pair of opposed sidewalls includes two parallel first retaining surfaces extending away from the base and along the sidewall, and the first retaining surfaces are a first distance away from each other. Each sidewall of the first pair of opposed sidewalls includes two parallel second retaining surfaces extending away from the first retaining surfaces and along the sidewall, and the second retaining surfaces are a second distance away from each other and the second distance is greater than the first distance. Each sidewall of the first pair of opposed sidewalls includes a pair of arcuate surfaces, each of the pair of arcuate surfaces extending from an associated one of the first retaining surface of the two parallel first retaining surfaces to an adjacent one of the second retaining surface of the two parallel second retaining surfaces. The storage box includes a rod having a first end and a second end, and the two parallel second retaining surfaces and the pair of arcuate surfaces associated with each sidewall of the first pair of opposed sidewalls are configured to support the first end or the second end.

In one feature, the storage box includes a handle attached to the first pair of opposed sidewalls or the second pair of opposed sidewalls.

According to another feature, the storage box includes a lid hinged on at least one of the first pair of opposed sidewalls or at least one of the second pair of opposed sidewalls.

As one feature, first retaining surfaces and the second retaining surfaces are parallel to at least one sidewall of the second pair of opposed sidewalls.

In one feature, the first pair of opposed sidewalls and the second pair of opposed sidewalls are perpendicular to the base, and the first pair of opposed sidewalls are perpendicular to the second pair of opposed sidewalls.

According to one feature, the storage box includes a dividing wall, and the first retaining surfaces are configured to support the dividing wall.

In accordance with one feature, a storage box includes a compartment having a base and two opposed sidewalls extending from the base. Each sidewall of the two opposed sidewalls includes two parallel first retaining surfaces extending away from the base and along the sidewall, and the first retaining surfaces are a first distance away from each other. Each sidewall of the two opposed sidewalls includes two parallel second retaining surfaces extending from the first retaining surfaces and along the sidewall, where the second retaining surfaces are a second distance away from each other and the second distance is greater than the first distance. The storage box includes an arcuate surface extending from at least one of the first retaining surfaces to at least one of the second retaining surfaces.

In one feature the storage box further includes a dividing wall, configured to slide into the compartment, having a first dividing wall end and a second dividing wall end. The first dividing wall end is configured to slide into the compartment between the first retaining surfaces and the second retaining surfaces associated with a first sidewall of the two opposed sidewalls. The second dividing wall end is configured to slide into the compartment between the first retaining surfaces and the second retaining surfaces associated with a second sidewall of the two opposed sidewalls.

According to another feature, the dividing wall has a thickness substantially the same as the first distance, and the first retaining surfaces are configured to engage the dividing wall when the dividing wall is slid into the compartment.

As one feature, the storage box includes a rod having a first end and a second end, and the second retaining surfaces and the arcuate surface associated with each of the two opposed sidewalls are configured to support the first end or the second end.

In one feature, the first retaining surfaces and the second retaining surfaces are perpendicular to an associated sidewall of the two opposed sidewalls.

In accordance with one feature, a storage box includes a compartment having a base and two opposed sidewalls extending from the base. Each sidewall of the two opposed sidewalls includes two parallel first retaining surfaces spaced a first distance away from each other and two parallel second retaining surfaces spaced a second distance away from each other. The two parallel first retaining surfaces extend away from the base, along a first distance of an associated sidewall of the two opposed sidewalls and between the two parallel second retaining surfaces. The two parallel second retaining surfaces extend above the first retaining surfaces along a second distance of the associated sidewall of the two opposed sidewalls, and the second length is greater than the first length. In a first configuration the storage box includes a rod and the first retaining surfaces are configured to support the rod. In a second configuration the storage box comprises a dividing wall and the first retaining surfaces or the second retaining surfaces are configured to support the dividing wall.

According to one feature, the storage box includes a third surface extending from one of the two first retaining surfaces to one of the two second retaining surfaces.

In one feature, the dividing wall has a width substantially the same as the first distance, and the dividing wall is supported by the first retaining surfaces.

According to one feature the dividing wall has a width substantially the same as the second distance, and the dividing wall is supported by second retaining surfaces and the third surface.

As one feature, the third surface is arcuate.

In one feature, the third surface is parallel to the base.

According to another feature, the storage box includes a handle attached to each of the two opposed sidewalls.

In accordance with one feature, the two opposed sidewalls are two first opposed sidewalls. The storage box includes two second opposed sidewalls extending from the base. The two second opposed sidewalls are perpendicular to the base, and the two parallel first retaining surfaces and the two parallel second retaining surfaces are parallel to the two second opposed sidewalls.

According to one feature, a flange comprises at least one of the two parallel first retaining surfaces and at least one of the two parallel second retaining surfaces.

It should be understood that the inventive concepts disclosed herein do not require each of the features discussed above, may include any combination of the features discussed, and may include features not specifically discussed above.

DETAILED DESCRIPTION OF PREFERRED EMBODIMENTS

Figure 1:
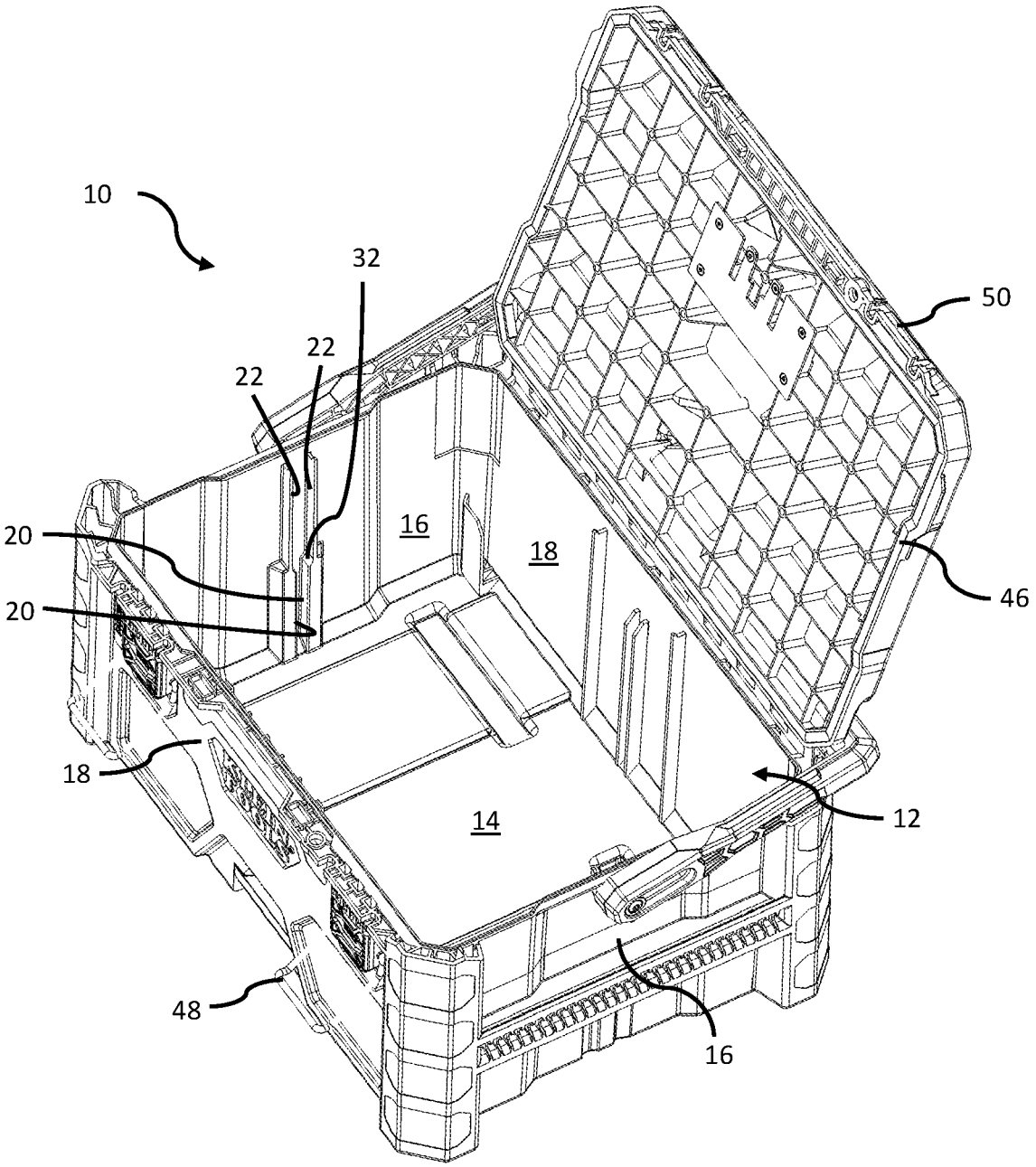
FIG. 1 is a perspective view from the front and side of a storage box with a lid in an open position to show an interior of the storage box.
Figure 2:
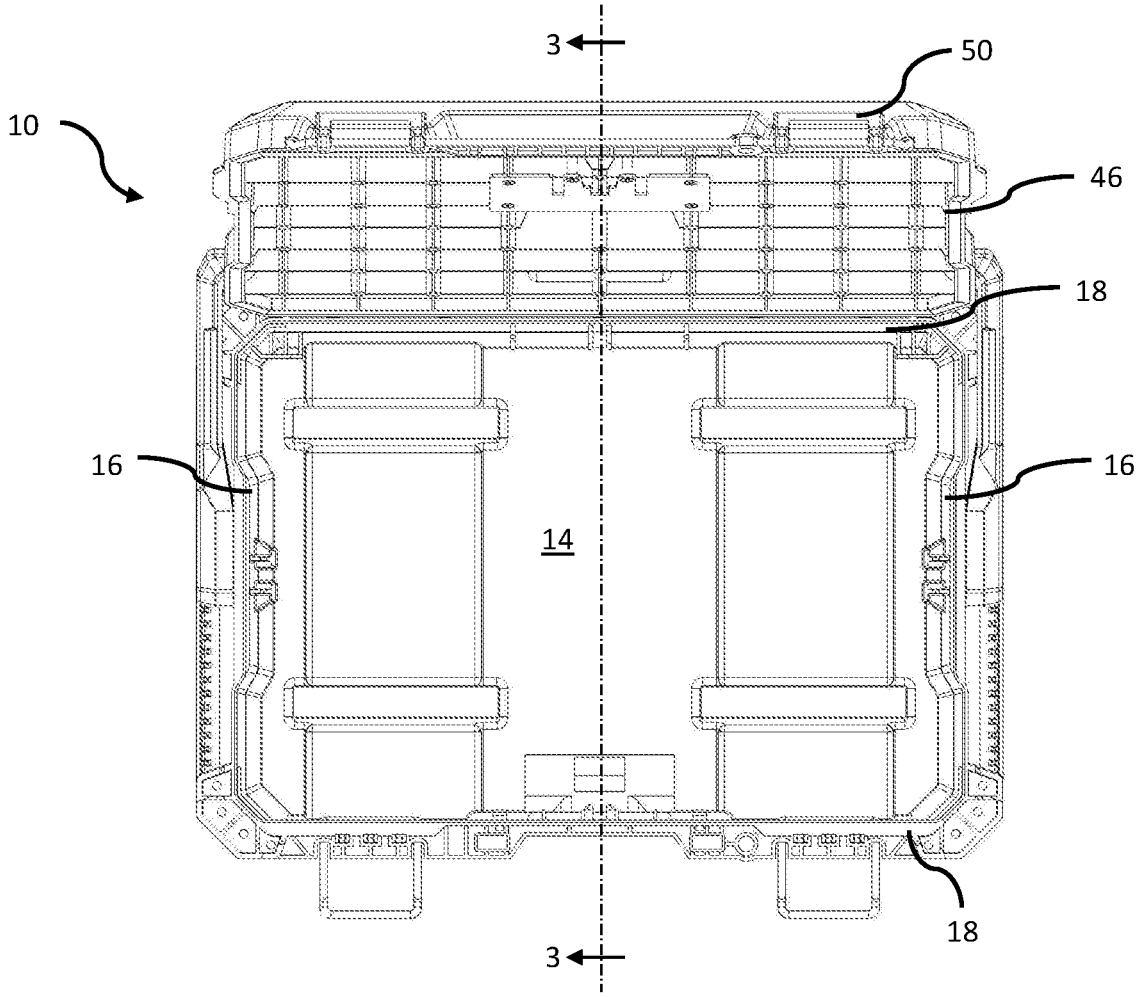
FIG. 2 is a top view of the storage box of FIG. 1.
Figure 3:
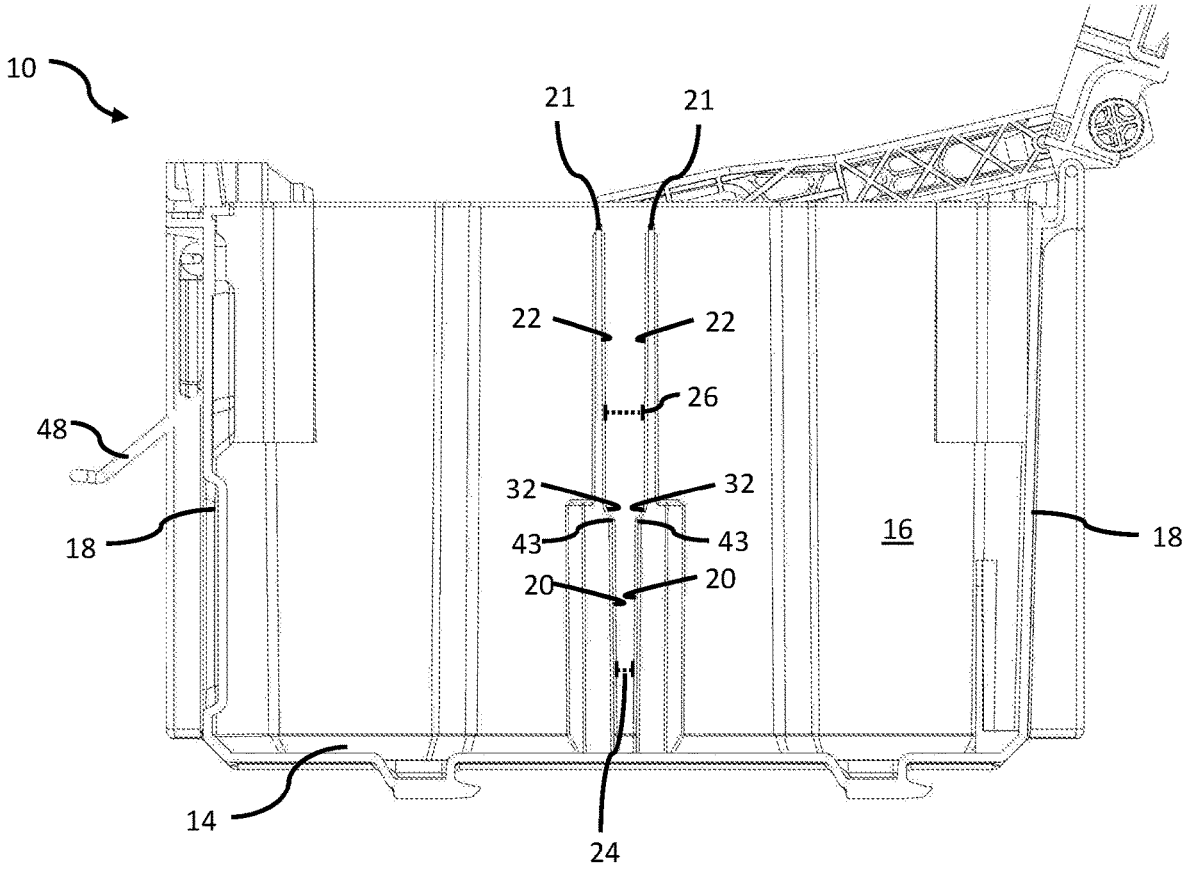
FIG. 3 is a section view taken along line 3-3 in FIG. 2.

As best seen in FIGS. 1-3, a storage box 10 is provided with support structure configured to support dividing walls or wire reels. In the illustrated and preferred embodiment, the storage box 10 includes an inner compartment 12 (e.g., interior compartment). The storage box has a base 14 and two opposed sidewalls 16 (e.g., end walls) extending perpendicularly from the base 14. In the illustrated and preferred embodiment, the storage box 10 includes a second pair of opposed sidewalls 18 (e.g., end walls) extending perpendicularly from the base 14 perpendicular to the two opposed sidewalls 16, and the compartment 12 is formed by the base 14, two opposed sidewalls 16, and second pair of opposed sidewalls 18.

As best shown in FIG. 3, each sidewall 16 includes two parallel first retaining surfaces 20 on two parallel ribs 21 (e.g., elongate rib structures). The first retaining surfaces 20 are spaced a first distance 24 away from each other. The two ribs 21 include two parallel second retaining surface 22 spaced a second distance 26 away from each other. In the illustrated and preferred embodiment, the first retaining surfaces 20 extend upwardly away from the base 14 and along the sidewall 16, with each of the two parallel first retaining surfaces 20 and two parallel second retaining surfaces 22 extending perpendicularly to the base and parallel to the second pair of opposed sidewalls 18. In the illustrated and preferred embodiment, the second distance 26 (e.g., the distance between the second retaining surfaces 22) is greater than the first distance 24 (e.g., the distance between the first retaining surfaces 20).

In the illustrated and preferred embodiment, the storage box includes a pair of support surfaces 32 (e.g., third surfaces), each shown in the form of an arcuate surface on the rib 21. Each support surface 32 extends from one of the first retaining surfaces 20 to one of the second retaining surfaces 22. In the illustrated and preferred embodiment, each support surface 32 is on one of the ribs 21.

Figure 4A:
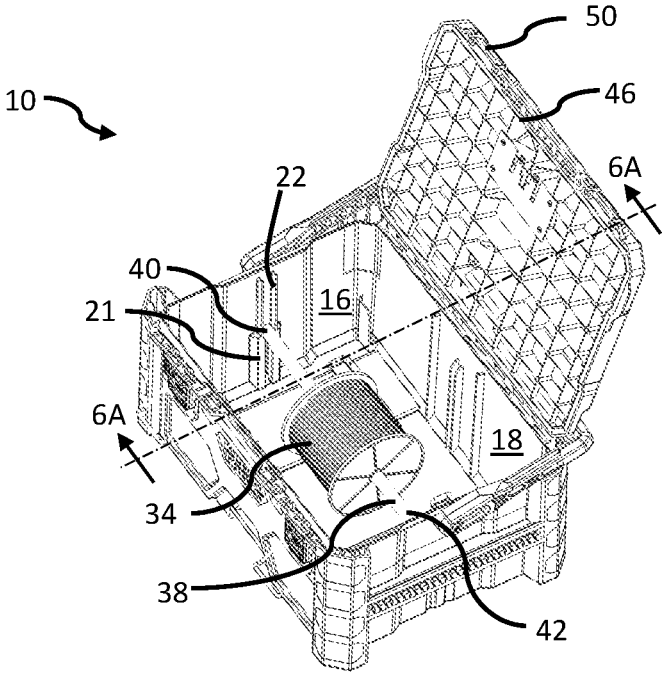
FIG. 4A is a perspective view from the front and side of the storage box of FIG. 1 with a wire reel shown in a mounted position in the interior of the storage box.
Figure 5A:
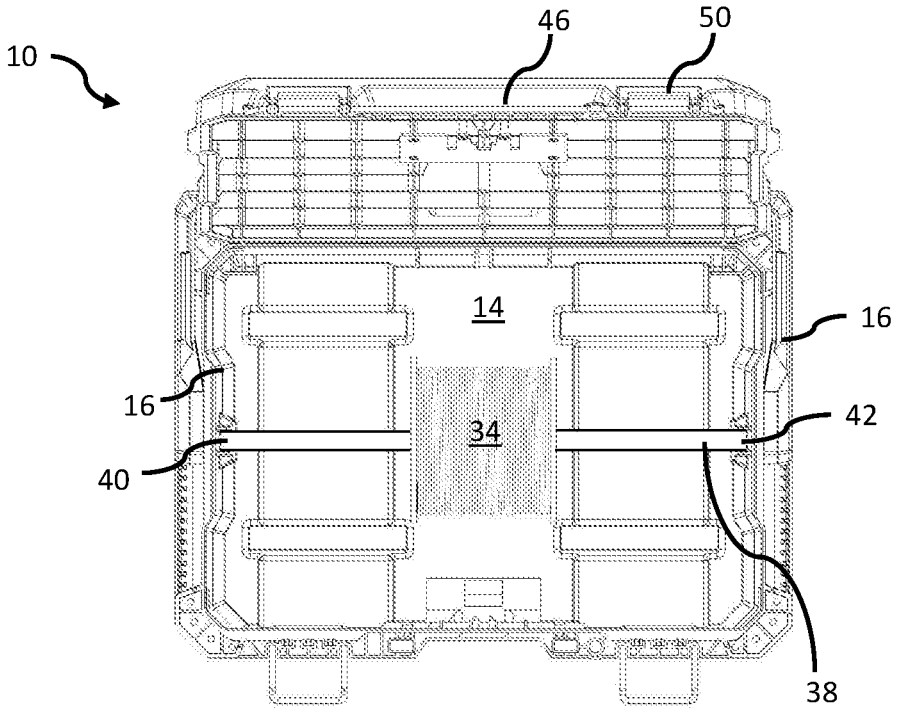
FIG. 5A is a top view of the storage box with the wire reel of FIG. 4A.
Figure 6A:
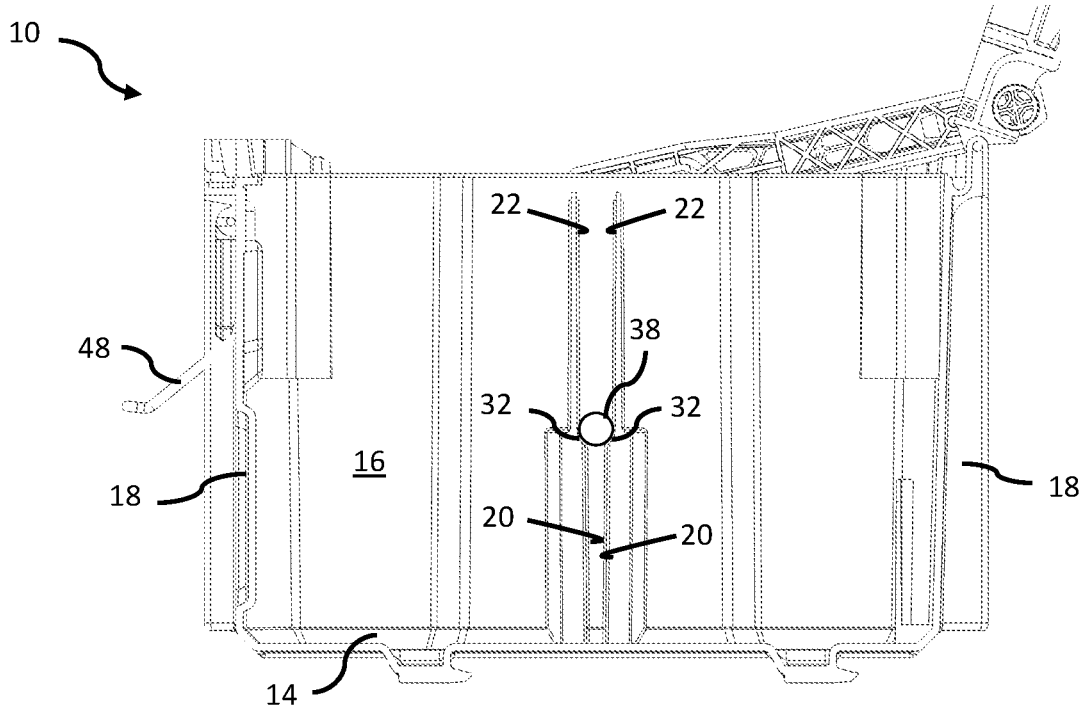
FIG. 6A is a section view taken along line 6A-6A in FIG. 4A.

In the illustrated and preferred embodiment, the storage box 10 may included a wire reel 34 (e.g., material reel) and/or a dividing wall 36. The storage box 10 in a first configuration with the wire reel 34 is shown in FIGS. 4A, 5A, and 6A. In the illustrated and preferred embodiment, the wire reel 34 is supported by a cylindrical rod 38 having a first end 40 and a second end 42. The wire reel 34 is configured to rotate (e.g., spin) around or with the rod 38 to dispense wire from the wire reel 34. In the illustrated and preferred embodiment, the first end 40 of the rod 38 is supported by the support surfaces 32 and/or a point 43 (e.g., support point, meeting point) where the support surface 32 meets the associated first retaining surface 20 of one of the sidewalls 16, and the second end 42 of the rod 38 is supported by the support surface 32 and/or the point 43 where the support surface 32 meets the associated first retaining surface 20 of the sidewall 16 opposing the sidewall 16 supporting the first end 40. In the illustrated and preferred embodiment, the rod 38 has a diameter substantially similar to or less than the second distance 26 such that the rod 38 may slide between the second retaining surfaces 22. The diameter of the rod 38 is greater than the first distance 24 such that support surfaces 32 and/or points 43 support the rod 38 and prevents the rod 38 from sliding between the first retaining surfaces 20. In examples where the support surfaces 32 are arcuate surfaces, the radius of curvature of the support surfaces 32 may be substantially similar to the radius of the rod 38. The arcuate surfaces are configured to support the rod and, in some examples, allow the rod 38 to rotate on the support surfaces 32.

Figure 4B:
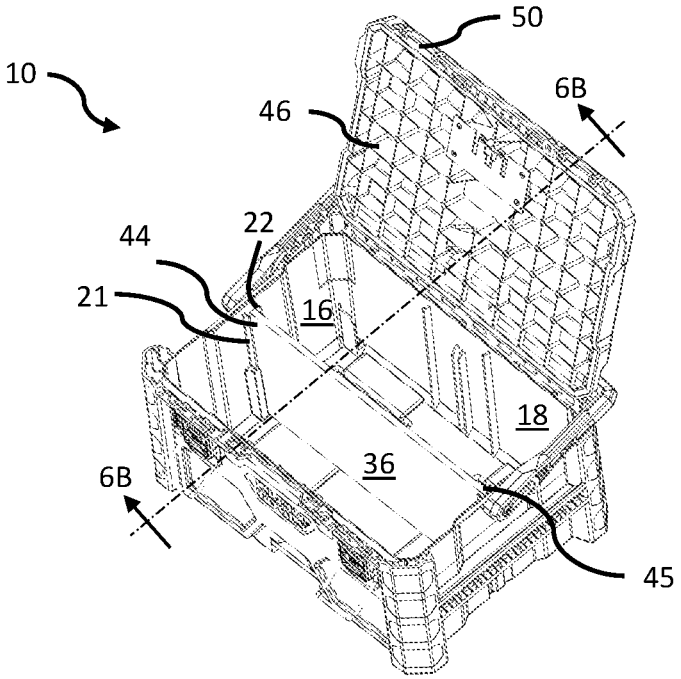
FIG. 4B is a perspective view from the front and side of the storage box of FIG. 1 with a partition shown in a mounted position in the interior of the storage box.
Figure 5B:
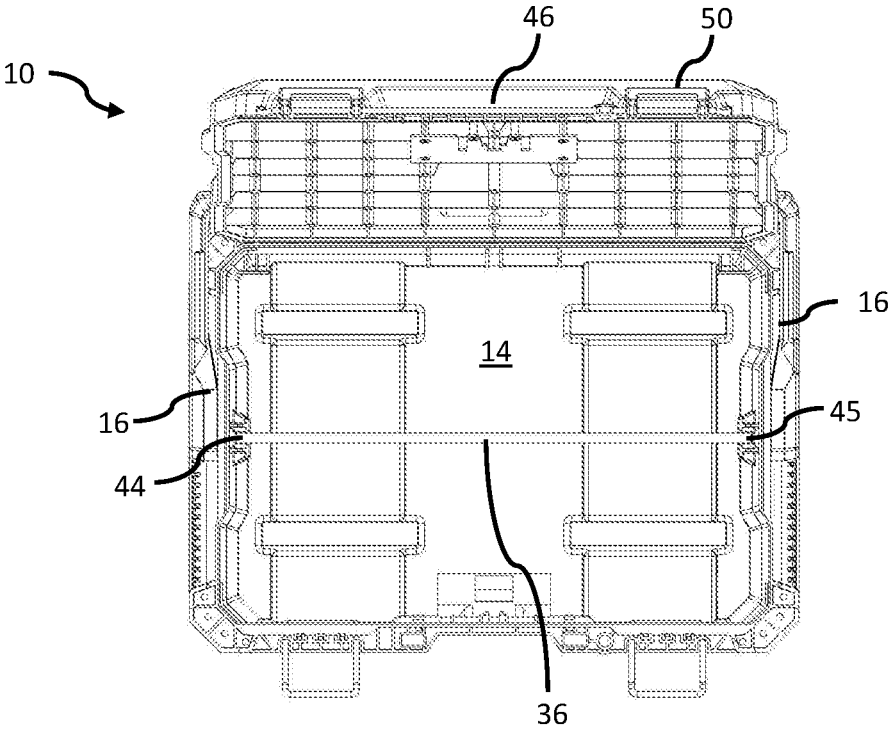
FIG. 5B is a top view of the storage box with the partition of FIG. 4B.
Figure 6B:
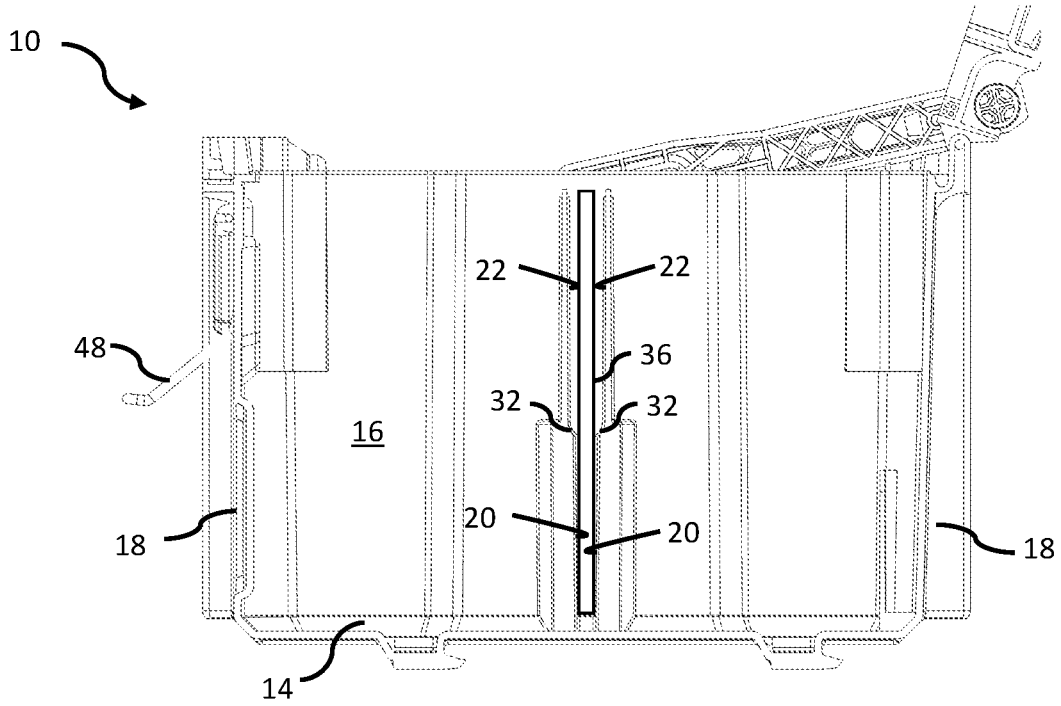
FIG. 6B is a section view taken along line 6B-6B in FIG. 4B.

The storage box 10 in a second configuration including the dividing wall 36 is shown in FIGS. 4B, 5B, and 6B. The dividing wall 36 may, for example, be a wood board. The dividing wall 36 includes a first dividing wall end 44 and a second dividing wall end 45. The first retaining surfaces 20 and the second retaining surfaces 22 are configured to allow the dividing wall 36 to slide therebetween such that the compartment 12 is divided into multiple smaller compartments. In the illustrated and preferred embodiment, the width of the dividing wall 36 is less than the second distance 26 and substantially the same as or less than the first distance 24 such that the dividing wall 36 slides between the second retaining surfaces 22 and is engaged and retained in an upright position (e.g., parallel to the two opposed sidewalls 16 and parallel to the second pair of opposed sidewalls 18) by the first retaining surface 20. In the illustrated and preferred embodiment, the first dividing wall end 44, when slid into the compartment 12, is supported and engaged by the first retaining surfaces 20 associated with one of the two opposed sidewalls 16, and the second dividing wall end 45 is supported and engaged by the first retaining surfaces 20 associated with the other sidewall 16 of the two opposed sidewalls 16. In configurations where the width of the dividing wall 36 is greater than the first distance 24 and/or substantially the same as the second distance 26, the dividing wall 36 slides between the second retaining surface 22, is supported by the support surface 32 and is engaged and retained in an upright position by the second retaining surfaces 22.

In the illustrated and preferred embodiment, the storage box 10 includes a lid 46. The lid 46 is hinged to one sidewall 18 of the second pair of opposed sidewalls 18 such that the lid 46 rotates relative to the sidewall 18 to enclose the compartment 12. In the illustrated and preferred embodiment, another sidewall 18 of the second pair of opposed sidewalls 18 includes a pair of latches 48, with each latch 48 configured to engage a latch receiver 50, shown in the form of a protruding lip, integral with the lid 46. When engaged with the latch receivers 50, the latches 48 retain the lid 46 in a closed position. The storage box further includes a handle 52. In the illustrated and preferred embodiment, the handle is rotatably attached to each of the two opposed sidewalls 16.

Figure 7:
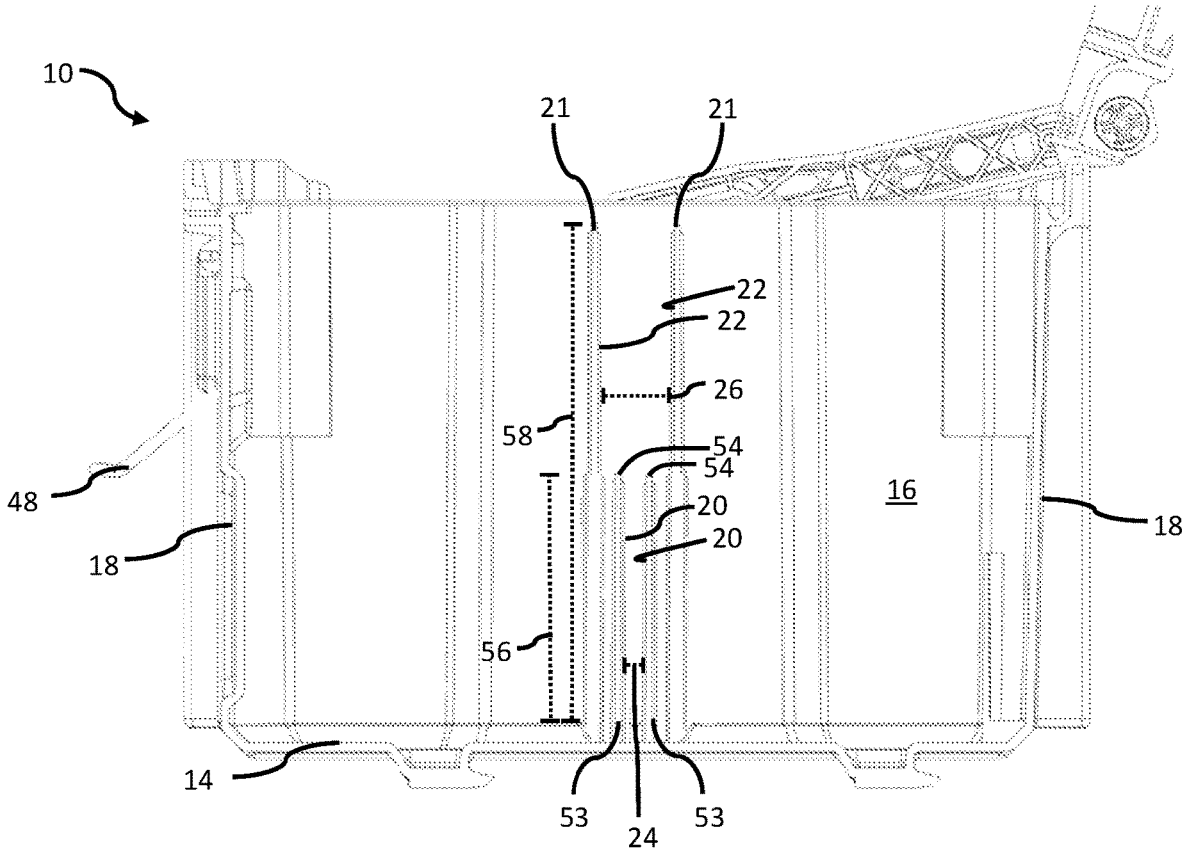
FIG. 7 is a section view similar to FIG. 3 showing different examples of retaining surfaces.

FIG. 7 shows another example of the storage box 10 similar to the section shown in FIG. 3, but with the first retaining surfaces 20 formed on second ribs 53 separated from the second retaining surfaces 22 on the ribs 21 (e.g., first ribs). In the illustrated and preferred embodiment, the ribs 21 with the second retaining surfaces 22 are separated from the second ribs 53 with the first retaining surfaces 20 by a gap. The second ribs 53 with the first retaining surfaces 20 extend along the sidewall 16 and between the ribs 21 with the second retaining surfaces 22. In the illustrated and preferred embodiment, first distance 24 between the first retaining surfaces 20 (e.g., the distance between the second ribs 53) is less than the second distance 26 between the second retaining surfaces 22 (e.g., the distance between the ribs 21). Further, this example does not include support surfaces 32 extending from the first retaining surfaces 20 to the second retaining surfaces 22. In configurations with the wire reel 34, the rod 38 will slide into the compartment 12 between the second retaining surfaces 22 and rest on (e.g., be supported by) a top portion 54 (e.g., top, top point, point) of each of the first retaining surfaces 20. In configurations with the dividing wall 36 where the width of the dividing wall 36 is less than or substantially the same as the first distance 24, the dividing wall 36 slides between the first retaining surfaces 20 of the second ribs and the second retaining surfaces 22 of the ribs 21 and is engaged and retained in an upright position by the first retaining surfaces 20. In configurations with a dividing wall 36, where the width of the dividing wall 36 is greater than the first distance 24 and/or substantially the same as the second distance 26, the dividing wall 36 slides between the second retaining surfaces 22, is supported by the top portion 54 of the first retaining surfaces 20, and is engaged and retained in an upright position by the second retaining surfaces 22.

Figure 8:
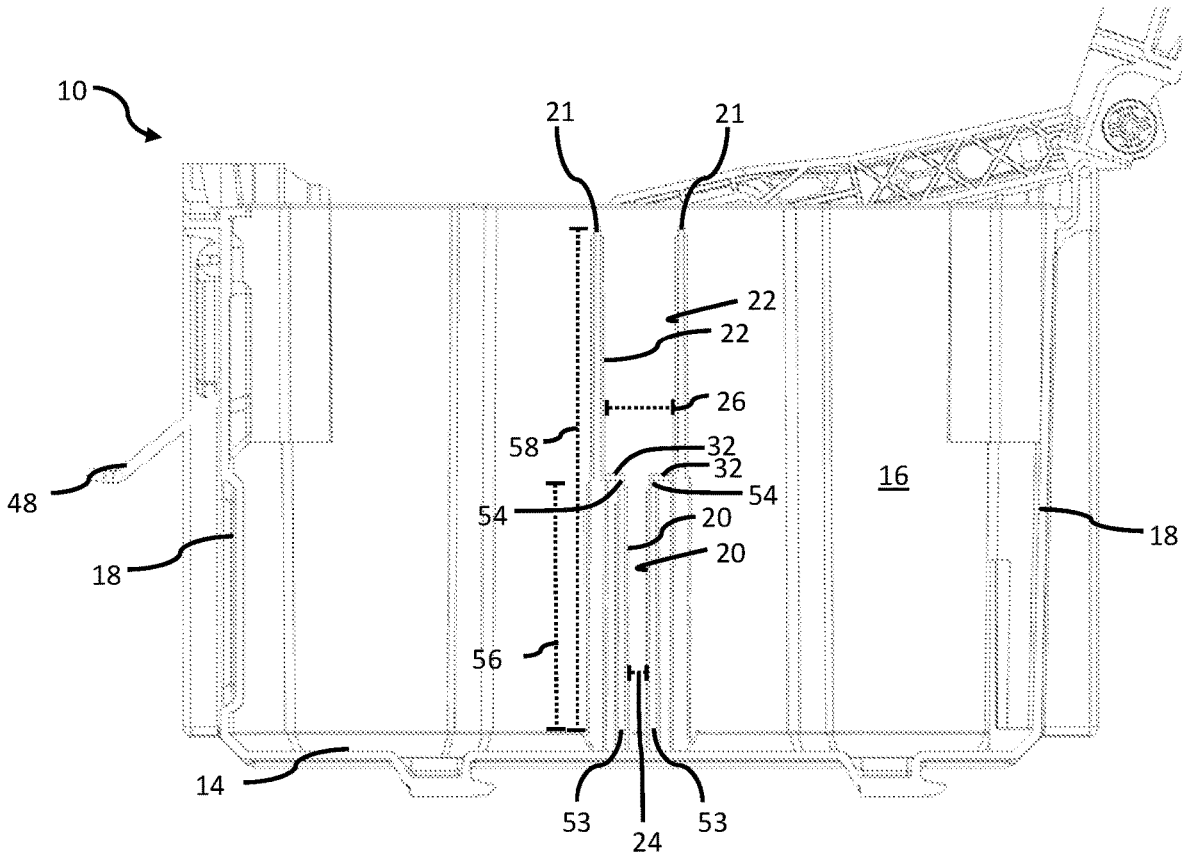
FIG. 8 is a section view similar to FIG. 7 but with a support surface extending from a first retaining surface to a second retaining surface.

FIG. 8 shows another example of the storage box 10 similar to the section shown in FIG. 7, but with support surfaces 32 extending from the top portions 54 of the second ribs 53 the adjacent rib 21. In this example, the support surfaces 32 are shown in the form of flat support surfaces parallel to the base 14. In configurations with the wire reel 34, the rod 38 may slide into the compartment 12 between the second retaining surfaces 22 and rest on (e.g., be supported by) the support surfaces 32 and/or the top portions 54 of the first retaining surfaces 20. In configurations with the dividing wall 36 where the width of the dividing wall 36 is less than or substantially the same as the first distance 24, the dividing wall 36 slides between the first retaining surfaces 20 and the second retaining surface 22 and is engaged and retained in an upright position by the first retaining surface 20. In configurations with a dividing wall 36 where the width of the dividing wall 36 is greater than the first distance 24 and/or substantially the same as the second distance 26, the dividing wall 36 slides between the second retaining surface 22, is supported by the support surface 32 and/or the top portions 54 of the first retaining surfaces 20, and is engaged and retained in an upright position by the second retaining surfaces 22.

In the embodiments shown in FIGS. 7, and 8, the second ribs 53 with the first retaining surfaces 20 extend a first length 56 along the sidewall 16, and the ribs 21 with the second retaining surfaces 22 extend a second length 58 along the sidewall. In these embodiments, the second length 58 is greater than the first length 56.

Preferred embodiments of the inventive concepts are described herein, including the best mode known to the inventor(s) for carrying out the inventive concepts. Variations of those preferred embodiments will become apparent to those of ordinary skill in the art upon reading the foregoing description. The inventor(s) expect skilled artisans to employ such variations as appropriate, and the inventor(s) intend that the inventive concepts can be practiced otherwise than as specifically described herein. Accordingly, the inventive concepts disclosed herein include all modifications and equivalents of the subject matter recited in the claims appended hereto as permitted by applicable law. Moreover, any combination of the above-described elements and features in all possible variations thereof is encompassed by the inventive concepts unless otherwise indicated herein or otherwise clearly contradicted by context. Further in this regard, while highly preferred forms of the storage box 10 are shown in the figures, it should be understood that this disclosure anticipates variations in the specific details of each of the disclosed components and features of the material dispenser and that no limitation to a specific form, configuration, or detail is intended unless expressly and specifically recited in an appended claim.

For example, while specific and preferred forms have been shown for the storage box 10 configured to allow for the use of wire reels 34, other items may be used. For example, any spooled length of wire or material that is mountable on a rod 38 may be supported by the storage box. Furthermore, the rod 38 can be any cross-sectional shape.

As another example, while a storage box 10 with a single compartment 12 is shown, the storage box 10 may include any number of compartments. Further, while two opposed sidewalls 16 and a second pair of opposed sidewalls 18 is shown, any number of sidewalls may be used. As another example, while the first retaining portions 20, second retaining portions 22, and support surface 32 are shown as a pair on each sidewall 16, any number of first retaining surfaces 20, second retaining surfaces 22, and support surfaces 32 may be included on the sidewalls 16, second sidewalls 18, or base 14. Further, while the support surface 32 is shown in the form of an arcuate surface and a flat surface, any shape of flat, angled, or curved surface may be used.

As another example, while parallel first retaining surfaces 20 and second retaining surfaces 22 are shown, the first retaining surfaces 20 and second retaining surfaces 22 may, in some examples, be approximately parallel or not parallel. Similarly, the sidewalls 16 and second pair of opposed sidewalls 18 are disclosed as being perpendicular to each other, in some examples they may be approximately perpendicular or not perpendicular. The sidewalls 16 and second pair of opposed sidewalls 18 are disclosed as being perpendicular to the base 14, while in some examples they may be approximately perpendicular or not perpendicular to the base 14. Similarly, the parallel first retaining surfaces 20 and the parallel second retaining surfaces 22 may be approximately parallel or not parallel.

In some examples related to the retaining surfaces, the storage box 10 may include third parallel retaining surfaces in addition to the parallel first retaining surfaces 20 and second retaining surfaces 22. The third retaining surfaces may allow for additional support surfaces 32, for example, extending between the third retaining surfaces and the first retaining surfaces 20 and/or the second retaining surfaces 22. While in some examples the support surface 32 is shown as connected to/unitary with the first retaining surface 20 or the second retaining surface 22, the support surface 32 may be remote from the first retaining surface 20 and/or the second retaining surface 22.

As a further example, while the dividing wall 36 is disclosed as being a wood board, any material may be used for the dividing wall 36 such as plastic, metal, etc. In some examples, the storage box 10 may include multiple dividing walls 36. In some examples, the storage box 10 may include dividing walls 36 and a wire reel 34. In some examples, the storage box 10 may include multiple wire reels 34.

In another example related to the handle 52, while the handle 52 is disclosed as rotatably attached to the two opposed sidewalls 16, in some examples the handle may be fixedly attached to the opposed sidewalls 16. In some examples, the handle 52 may be attached to other portions of the storage box 10, such as the second pair of opposed sidewalls 18 or the lid 46.

In some examples, the two opposed sidewalls 16, the second pair of opposed sidewalls 18, or the lid 46 may include an opening to allow the storage box 10 to dispense material from the wire reel 34 with the lid 46 in a closed position.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. The use of any and all examples, or exemplary language (e.g., "such as") provided herein, is intended merely to better illuminate the inventive concepts disclosed herein and does not pose a limitation on the scope of any invention unless expressly claimed. No language in the specification should be construed as indicating any non-claimed element as essential to the practice of the inventive concepts disclosed herein.

What is claimed is:

1. A storage box comprising:

a compartment having a base, a first pair of opposed sidewalls extending from the base, and a second pair of opposed sidewalls extending from the base;

wherein each sidewall of the first pair of opposed sidewalls comprises:

two parallel first retaining surfaces extending away from the base and along the sidewall, wherein the first retaining surfaces are a first distance away from each other; and two parallel second retaining surfaces extending away from the first retaining surfaces and along the sidewall, wherein the second retaining surfaces are a second distance away from each other and the second distance is greater than the first distance; and a pair of arcuate surfaces, each of the pair of arcuate surfaces extending from an associated one of the first retaining surface of the two parallel first retaining surfaces to an adjacent one of the second retaining surface of the two parallel second retaining surfaces; and a rod having a first end and a second end; and wherein the two parallel second retaining surfaces and the pair of arcuate surfaces associated with each sidewall of the first pair of opposed sidewalls are configured to support the first end or the second end.

2. The storage box of claim 1, further comprising a handle attached to the first pair of opposed sidewalls or the second pair of opposed sidewalls.

3. The storage box of claim 1, further comprising a lid hinged on at least one of the first pair of opposed sidewalls or at least one of the second pair of opposed sidewalls.

4. The storage box of claim 1, wherein the first retaining surfaces and the second retaining surfaces are parallel to at least one sidewall of the second pair of opposed sidewalls.

5. The storage box of claim 4, wherein:

the first pair of opposed sidewalls and the second pair of opposed sidewalls are perpendicular to the base; and the first pair of opposed sidewalls are perpendicular to the second pair of opposed sidewalls.

6. The storage box of claim 1, further comprising a dividing wall, wherein the first retaining surfaces are configured to support the dividing wall.

7. The storage box of claim 1, further comprising a handle attached to each of the two opposed sidewalls.

8. The storage box of claim 1, wherein the two opposed sidewalls are two first opposed sidewalls, further comprising:

two second opposed sidewalls extending from the base;

wherein the two second opposed sidewalls are perpendicular to the base; and wherein the two parallel first retaining surfaces and the two parallel second retaining surfaces are parallel to the two second opposed sidewalls.

9. A storage box comprising:

a compartment having a base and two opposed sidewalls extending from the base;

wherein each sidewall of the two opposed sidewalls comprises:

two parallel first retaining surfaces extending away from the base and along the sidewall, wherein the first retaining surfaces are a first distance away from each other;

two parallel second retaining surfaces extending from the first retaining surfaces and along the sidewall, wherein the second retaining surfaces are a second distance away from each other and the second distance is greater than the first distance;

an arcuate surface extending from at least one of the first retaining surfaces to at least one of the second retaining surfaces; and a rod having a first end and a second end;

wherein the second retaining surfaces and the arcuate surface associated with each of the two opposed sidewalls are configured to support the first end or the second end.

10. The storage box of claim 9, wherein the storage box further comprises:

a dividing wall, configured to slide into the compartment, having a first dividing wall end and a second dividing wall end;

wherein the first dividing wall end is configured to slide into the compartment between the first retaining surfaces and the second retaining surfaces associated with a first sidewall of the two opposed sidewalls; and wherein the second dividing wall end is configured to slide into the compartment between the first retaining surfaces and the second retaining surfaces associated with a second sidewall of the two opposed sidewalls.

11. The storage box of claim 10, wherein the dividing wall has a thickness substantially the same as the first distance, and the first retaining surfaces are configured to engage the dividing wall when the dividing wall is slid into the compartment.

12. The storage box of claim 9, wherein the first retaining surfaces and the second retaining surfaces are perpendicular to an associated sidewall of the two opposed sidewalls.

13. A storage box comprising:

a compartment having a base and two opposed sidewalls extending from the base;

wherein each sidewall of the two opposed sidewalls comprises:

two parallel first retaining surfaces spaced a first distance away from each other; and two parallel second retaining surfaces spaced a second distance away from each other;

wherein the two parallel first retaining surfaces extend away from the base, along a first distance of an associated sidewall of the two opposed sidewalls and between the two parallel second retaining surfaces; and wherein the two parallel second retaining surfaces extend above the first retaining surfaces along a second distance of the associated sidewall of the two opposed sidewalls; and wherein the second length is greater than the first length;

wherein in a first configuration the storage box comprises a rod and the first retaining surfaces are configured to support the rod; and wherein in a second configuration the storage box comprises a dividing wall and the first retaining surfaces or the second retaining surfaces are configured to support the dividing wall.

14. The storage box of claim 13, further comprising a third surface extending from one of the two first retaining surfaces to one of the two second retaining surfaces.

15. The storage box of claim 14, further comprising:

the dividing wall has a width substantially the same as the second distance; and the dividing wall is supported by second retaining surfaces and the third surface.

16. The storage box of claim 14, wherein the third surface is arcuate.

17. The storage box of claim 14, wherein the third surface is parallel to the base.

18. The storage box of claim 13, wherein:

the dividing wall has a width substantially the same as the first distance; and the dividing wall is supported by the first retaining surfaces.

19. The storage box of claim 13, further comprising a flange comprising at least one of the two parallel first retaining surfaces and at least one of the two parallel second retaining surfaces.

* * * * *